US006173487B1

(12) United States Patent
Murata et al.

(10) Patent No.: US 6,173,487 B1
(45) Date of Patent: Jan. 16, 2001

(54) RESISTOR UNIT FOR A FAN SPEED CONTROLLER OF AN AUTOMOTIVE AIR CONDITIONING DEVICE

(75) Inventors: Hiroyuki Murata; Takashi Ishii, both of Tochigi (JP); Shuko Yamamoto, Irvine, CA (US)

(73) Assignees: Calsonic Corporation; Calsonic Products, Inc., both of Tokyo (JP)

( * ) Notice: Under 35 U.S.C. 154(b), the term of this patent shall be extended for 0 days.

(21) Appl. No.: 09/182,512

(22) Filed: Oct. 30, 1998

Related U.S. Application Data

(62) Division of application No. 08/811,167, filed on Mar. 4, 1997, now Pat. No. 5,867,086.

(30) Foreign Application Priority Data

Mar. 5, 1997 (JP) ..... 8-14406
Mar. 5, 1997 (JP) ..... 8-44714
Mar. 5, 1997 (JP) ..... 8-44715

(51) Int. Cl.[7] ..... H01C 17/28

(52) U.S. Cl. ..... 29/619; 29/592.1; 29/610.1; 29/613; 338/53; 338/50

(58) Field of Search ..... 29/613, 619, 610.1, 29/592.1; 338/22, 24, 50, 51, 53, 95, 220, 221, 26, 315

(56) References Cited

U.S. PATENT DOCUMENTS 3,478,424 * 11/1969 Meoni ..... 29/619
5,000,662 3/1991 Yamamoto et al. ..... 417/32
5,192,940 3/1993 Yagima et al. ..... 338/308
5,218,336 6/1993 Murakami et al. ..... 338/328
5,339,362 8/1994 Harris et al. ..... 381/86
5,703,561 12/1997 Yamamoto et al. ..... 338/53

FOREIGN PATENT DOCUMENTS 1-125708 8/1989 (JP) .
2-145507 12/1990 (JP) .

* cited by examiner

*Primary Examiner*—Lee Young
*Assistant Examiner*—Sean Smith
(74) *Attorney, Agent, or Firm*—Foley & Lardner

(57) ABSTRACT

A fan speed controller of an automotive vehicle air conditioning device is usually placed in an air flow duct to be effectively cooled. Thus, compact construction of the speed controller is needed to obtain a larger air flow in the air flow duct. For this purpose, various compact resistor units for the speed controller have been proposed. However, some of them are poor in durability against shocks. In view of this, a compact resistor unit for a speed controller includes a resistor block that has a flat resistor, a flat insulating plate and a flat radiation plate which are respectively positioned against one another. The compact resistor unit further includes a holder block of molded plastic on which the resistor block is mounted. The compact resistor unit also includes a plurality of metal terminals partially embedded in the holder block, where the terminals are connected to particular portions of the flat resistor. The compact resistor still further includes metal connecting lugs that are partially embedded in the holder block, and rivets for securing the resistor block to the connecting lugs.

5 Claims, 6 Drawing Sheets

RESISTOR UNIT FOR A FAN SPEED CONTROLLER OF AN AUTOMOTIVE AIR CONDITIONING DEVICE

This application is a divisional of application Ser. No. 08/811,167, filed Mar. 4, 1997 now U.S. Pat. No. 5,867,086.

BACKGROUND OF THE INVENTION

1. Field of the Invention

The present invention relates in general to a resistor unit, and more particularly to a resistor unit installed in a speed controller for controlling the speed of a fan motor employed in an automotive air conditioning device, and a method of producing the resistor unit. More specifically, the present invention is concerned with a resistor unit which generally comprises a resistor block including a flat resistor, a flat insulating plate and a flat heat radiation plate which are respectively positioned against one another, a holder block of molded plastic having the resistor block mounted thereon, a plurality of terminals partially embedded in the holder block and connected to given portions of the flat resistor, and coupling means for coupling the resistor block with the holder block.

2. Description of the Prior Art

A blower unit of an automotive air conditioning device has a blower installed therein. The blower has a fan held in a fan scroll and driven by an electric motor. The speed of the motor is controlled by a speed controller. The speed controller has a resistor unit including a plurality of resistors connected in series. By varying the total resistance of the resistor unit, the voltage applied to the electric motor is varied, so that the rotation speed of the fan can be controlled to, for example, a high level, a neutral level or a low level.

For cooling the speed controller, the speed controller is usually placed in an air flow duct of the air conditioning device through which cool air flows. Thus, it is desired to reduce the size of the speed controller as small as possible for obtaining a satisfactory air flow in the air flow duct.

Hitherto, for reducing the size and weight of the speed controller, there has been proposed a compact resistor unit called "flat resistance" which generally comprises a flat insulating base board and a resistor pattern printed on the base board. The compact unit having such a flat resistance type is shown in, for example, Japanese Utility Model First Provisional Publications Nos. 1-125708 & 2-145507.

Furthermore, at present, there has been proposed a very compact light weight resistor unit, which is schematically shown in FIG. 8 of the accompanying drawings.

As shown in the drawing, the resistor unit comprises a flat resistor 1, two flat insulating plates 2*a* and 2*b* which are placed in intimate contact against the respective opposite surfaces of the flat resistor 1, and two flat heat radiation plates 3*a* and 3*b* which are placed in intimate contact against the outer surfaces of the two flat insulating plates 2*a* and 2*b*. With the parts thus united, a resistor proper part 4 is created.

The resistor block 4 is mounted to a terminal-mounted plastic holder block 6. That is, the holder block 6 has a plurality of terminals 5 of metal mounted thereto. The holder block 6 comprises a rectangular coupler portion 7 and an elongate flange portion 8 on which the terminals 5 are aligned. Each terminal 5 has a lower part embedded in the plastic holder block 6. A so-called "insert molding technique" is used for producing the terminal-mounted plastic holder block 6.

The flange portion 8 is integrally formed at both ends thereof with connecting lugs 9*a* and 9*b* through which the resistor block 4 is secured to the holder block 6 with the aid of rivets 10. That is, each rivet 10 extending between the heat radiation plates 3*a* and 3*b* is tightly received in an opening formed in the connecting lug 9*a* or 9*b*. Although not shown in the drawing, upper portions of the heat radiation plates 3*a* and 3*b* are connected through other rivets. Designated by numeral 11 is a projected portion in which a fuse (not shown) is installed.

However, due to inherent construction, the above-mentioned resistor unit has failed to achieve a satisfied durability against shocks applied thereto. That is, because the connecting lugs 9*a* and 9*b* are constructed of plastic which is poor in durability, it tends to occur that the lugs 9*a* and 9*b* are broken or at least damaged when a strong shock is applied thereto. In fact, such breakage tends to occur when the rivets 10 are brought into engagement with the lugs 9*a* and 9*b* for fixing the resistor block 4 to the holder block 6. Such breakage becomes much severe when the plastic lugs 9*a* and 9*b* are deteriorated due to long usage of the resistor unit. Furthermore, the plastic lugs 9*a* and 9*b* have poor dimensional stability, which tends to induce a loose assembly of the resistor unit.

Furthermore, hitherto, the arrangement of a fuse for such resistor unit has been given little consideration. In fact, in a conventional arrangement of a fuse, there is a possibility that a burnt out part of the fuse causes a short-circuit of two parts. That is, when the fuse is actually operated, the burnt out part of the fuse tends to dangle from a proper position, thereby increasing the possibility of such undesired short-circuit. In fact, the burnt out part of fuse tends to induce various problems in the circuit.

SUMMARY OF THE INVENTION

It is therefore an object of the present invention to provide a resistor unit of an automotive air conditioning device, which is free of the above-mentioned drawbacks.

It is a main object of the present invention to provide a resistor unit of an automotive air conditioning device, which has a satisfactory durability against shocks applied thereto.

It is another object of the present invention to provide a resistor unit of an automotive air conditioning device, which is equipped with a fuse holding structure by which operation of a fuse is assured.

It is still another object of the present invention to provide a resistor unit of an automotive air conditioning device, which is equipped with a fuse holding structure by which a fuse is tightly held in a fuse receiving portion of the resistor unit.

It is a further object of the present invention to provide a method of producing the resistor unit.

According to a first aspect of the present invention, there is provided a resistor unit which comprises a resistor block including a flat resistor, a flat insulating plate and a flat heat radiation plate which are respectively positioned against one another; a holder block of molded plastic on which the resistor block is mounted; a plurality of terminals of metal partially embedded in the holder block, the terminals being connected to given portions of the flat resistor; connecting lugs partially embedded in the holder block; and securing means for securing the resistor block to the connecting lugs, wherein the connecting lugs are constructed of metal.

According to a second aspect of the present invention, there is provided a resistor unit which comprises a resistor block including a flat resistor, a flat insulating plate and a flat heat radiation plate which are respectively positioned against one another; a holder block of molded plastic on which the resistor block is mounted; a plurality of terminals of metal partially embedded in the holder block, the terminals being connected to given portions of the flat resistor; a fuse connected to selected two of the terminals; means for defining in the selected two terminals respective recesses which are positioned below the fuse, the recesses being so sized and shaped so as not to establish an electric connection or short-circuit between the selected two terminals by the fuse once the fuse is actually operated; and means for coupling the resistor block with the holder block.

According to a third aspect of the present invention, there is provided a resistor unit which comprises a resistor proper part including a flat resistor, a flat insulating plate and a flat heat radiation plate which are respectively positioned against one another; two projections formed on separated resistor pattern parts of the flat resistor; a fuse connected to the projections to extend therebetween, the fuse and the two projections thus constituting a raised structure which projects toward the flat heat insulating plate; means for defining by the flat insulating plate a hinged tongue portion pressed out therefrom; means for defining by the flat heat radiation plate a fuse receiving portion; a holder block of molded plastic on which the resistor block is mounted; a plurality of terminals of metal partially embedded in the holder block, the terminals being connected to given portions of the flat resistor; and means for coupling the resistor block with the holder block, wherein when the flat resistor, the flat insulating plate and the flat heat radiation plate are assembled, the raised structure presses the tongue portion of the flat insulating plate against an inner wall of the fuse receiving portion.

According to a fourth aspect of the present invention, there is provided a method of producing a resistor unit, which comprises the steps of (a) stamping a metal sheet to produce a comb-like single metal sheet, the comb-like single metal sheet having a plurality of semi-finish portions which are integrally connected through thin strip portions; (b) molding a semi-finish product of a molded holder block using the comb-like single metal sheet as an insert, the semi-finish product having the semi-finish portions exposed; (c) removing the thin strip portions from the comb-like single metal sheet to produce mutually isolated terminals and connecting lugs thereby to finally produce the molded holder block; and (d) mounting a resistor block tightly to the molded holder block using the connecting lugs as a structurally basic connector means therebetween.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, a resistor unit of the present invention will be described in detail with reference to the drawings.

Figure 8:
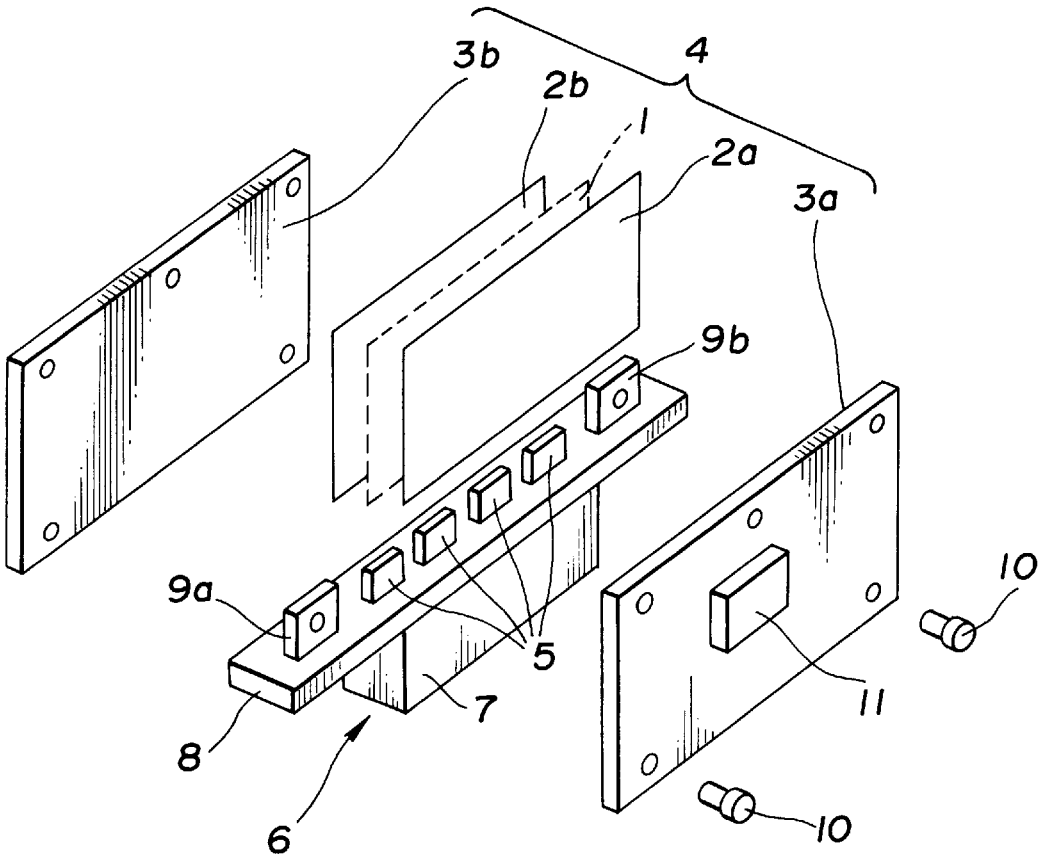
FIG. 8 (PRIOR ART)
FIG. 8 is an exploded view of a conventional compact resistor unit of flat type.

It is to be noted that the entire construction of the resistor unit of the invention is similar to that of the above-mentioned conventional resistor unit shown in FIG. 8.

That is, the resistor unit of the invention comprises generally a resistor block which is substantially the same as the resistor block 4 of FIG. 8 and a terminal-mounted plastic holder block 60 (see FIG. 1) which is different from the terminal-mounted plastic holder block 6 of FIG. 8.

As can readily be seen from FIG. 8, the resistor block 4 of the present invention comprises a flat resistor 1, two flat insulating plates 2*a* and 2*b* which intimately put therebetween the flat resistor 1 and two heat radiation plates 3*a* and 3*b* which intimately put therebetween the insulating plates 2*a* and 2*b*. The flat resistor 1 is a stamped resistance plate having a given pattern. The insulating plates 2*a* and 2*b* are made of mica or the like, and the heat radiation plates 3*a* and 3*b* are made of aluminum or the like. One of the heat radiation plates 3*a* and 3*b* is formed with a fuse receiving portion 11 in which an after-mentioned fuse 12 (see FIG. 1) is installed.

Figure 1:
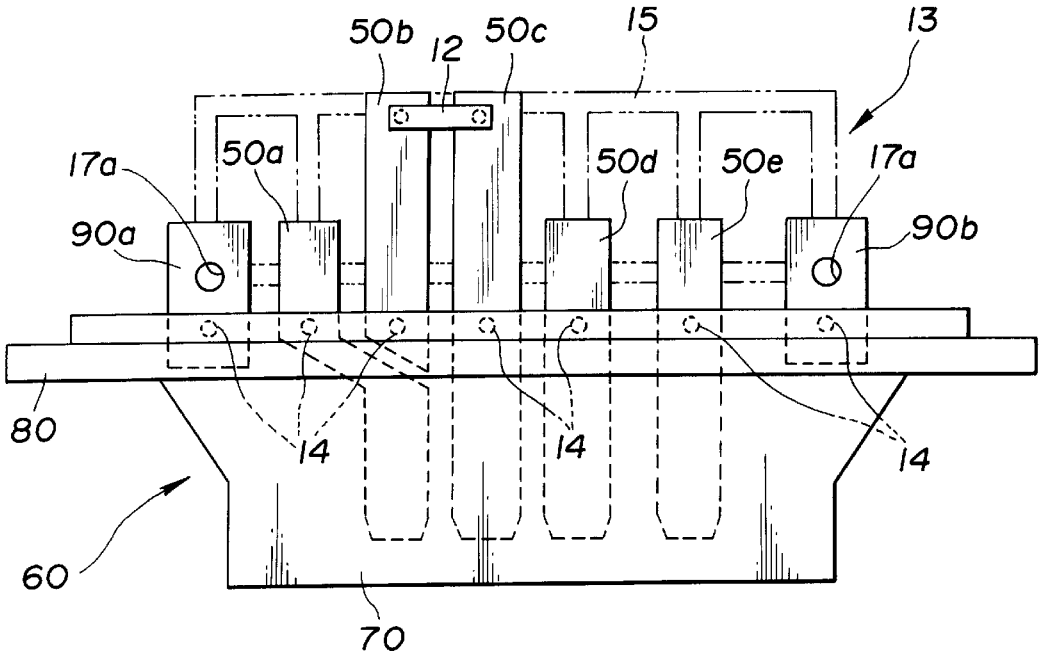
FIG. 1 is a schematic side view of a terminal-mounted plastic holder block used in a resistor unit of the present invention.

As is seen from FIG. 1, the terminal-mounted plastic holder block 60 of the present invention comprises a rectangular coupler portion 70 and an elongate flange portion 80 on which a plurality of terminals 50*a*, 50*b*, 50*c*, 50*d* and 50*e* of metal are aligned. Each terminal 50*a*, 50*b*, 50*c*, 50*d* or 50*e* has a lower part embedded in the holder block 60, as shown.

It is to be noted that, in the present invention, connecting lugs 90*a* and 90*b* corresponding to the connecting lugs 9*a* and 9*b* of FIG. 8 are constructed of metal. Each connecting lug 90*a* or 90*b* has a lower part embedded in the flange portion 80, as shown. Insert molding technique is used for producing the terminal-mounted plastic holder block 60.

As will be described in detail hereinafter, the connecting lugs 90*a* and 90*b* and the terminals 50*a*, 50*b*, 50*c*, 50*d* and 50*e* have been integrally connected before their separation. That is, they are portions which have constitute a comb-like single metal sheet 13 such as that shown in FIG. 2.

Similar to case of the conventional resistor unit of FIG. 8, the resistor proper part 4 is mounted to the plastic holder block 60. For this mounting, the connecting lugs 90*a* and 90*b* of metal respectively receive the rivets 10 which extend between the heat radiation plates 3*a* and 3*b*. Particular portions of the flat resistor 1 are spot-welded to selected ones, for example, the terminals 50*a*, 50*d* and 50*e* of the terminals 50*a* to 50*e*.

As is seen from FIG. 1, a fuse 12 is arranged to connect the terminals 50*b* and 50*c*. When subjected to an excessive current flows, the fuse 12 is melted down to protect an electric circuit of the speed controller. The fuse 12 is received in the fuse receiving portion 11 of the heat radiation plate 3*a* (see FIG. 8).

In the following, a method of producing the resistor unit according to the present invention will be described with reference to the drawings.

Since the method of producing the resistor proper part 4 is known, only the method of producing the holder block 60 will be described in detail in the following.

Figure 2:
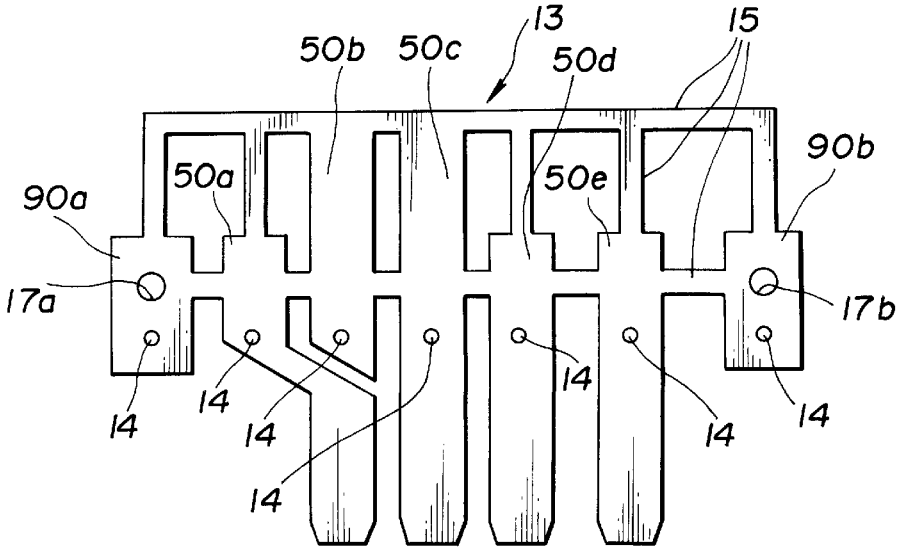
FIG. 2 is a plan view of a comb-like metal sheet which is subjected to an insert molding for producing the resistor unit of the invention.

By stamping or punching a metal sheet, a comb-like metal sheet 13 as shown in FIG. 2 is produced. The metal sheet may be of steel, brass or the like. As is seen from the drawing, the shaped metal sheet 13 thus produced has various corresponding portions of the terminals 50*a* to 50*e* and the connecting lugs 90*a* and 90*b*, which are integrally connected through thin strip portions 15. The shaped metal sheet 13 is formed with a plurality of openings 14 at lower parts of the various corresponding portions. The portions corresponding to the connecting lugs 90*a* and 90*b* are formed with circular openings 17*a* and 17*b*, respectively.

The shaped metal sheet 13 is then subjected to an insert molding to produce a semi-finish product of the holder block 60. That is, the semi-finish product has such a construction as is illustrated by the solid line and the phantom line in FIG. 1. With this molding, the apertured lower parts of the corresponding portions 50*a* to 50*e* and 90*a* and 90*b* of the shaped metal sheet 13 are embedded in the molded plastic holder block 60, as is seen from FIG. 1. Then, the thin strip portions 15 are removed from the metal sheet 13 to isolate and produce the terminals 50*a* to 50*e* and the connecting lugs 90*a* and 90*b*. Then, a fuse 12 is connected to the terminals 50*b* and 50*c* by using a thin solder. With this, a finished product of the holder block 60 is provided, which is illustrated by only the solid line in FIG. 1. As shown in this drawing, the terminals 50*b* and 50*c* for the fuse 12 have upper portions longer than those of the remaining terminals 50*a*, 50*d* and 50*e*.

For assembling the resistor unit according to the present invention, the resistor block 4 is mounted to the holder block 60 by using the rivets 10. That is, the circular openings 17*a* and 17*b* of the connecting lugs 90*a* and 90*b* tightly receive the rivets 10 which extend between the heat radiation plates 3*a* and 3*b*.

In the following, advantages possessed by the above-mentioned resistor unit of the invention will be described.

Since the connecting lugs 90*a* and 90*b* are constructed of metal, the drawbacks possessed by the conventional plastic connecting lugs 9*a* and 9*b* are eliminated. That is, due to usage of metal, durability of the connecting lugs 90*a* and 90*b* and thus that of the resistor unit is greatly increased. In addition, the dimensional stability of the lugs 90*a* and 90*b* is greatly improved, which induces a precise and tight assembly of the resistor unit.

Since the connecting lugs 90*a* and 90*b* and the terminals 50*a* to 50*e* are supplied by the same metal sheet 13, the method of producing the resistor unit is quite simplified as compared with the production method of the conventional resistor unit of FIG. 8.

In the following, two modifications of the present invention will be described with reference to FIGS. 3 to 7 of the accompanying drawings.

Figure 3:
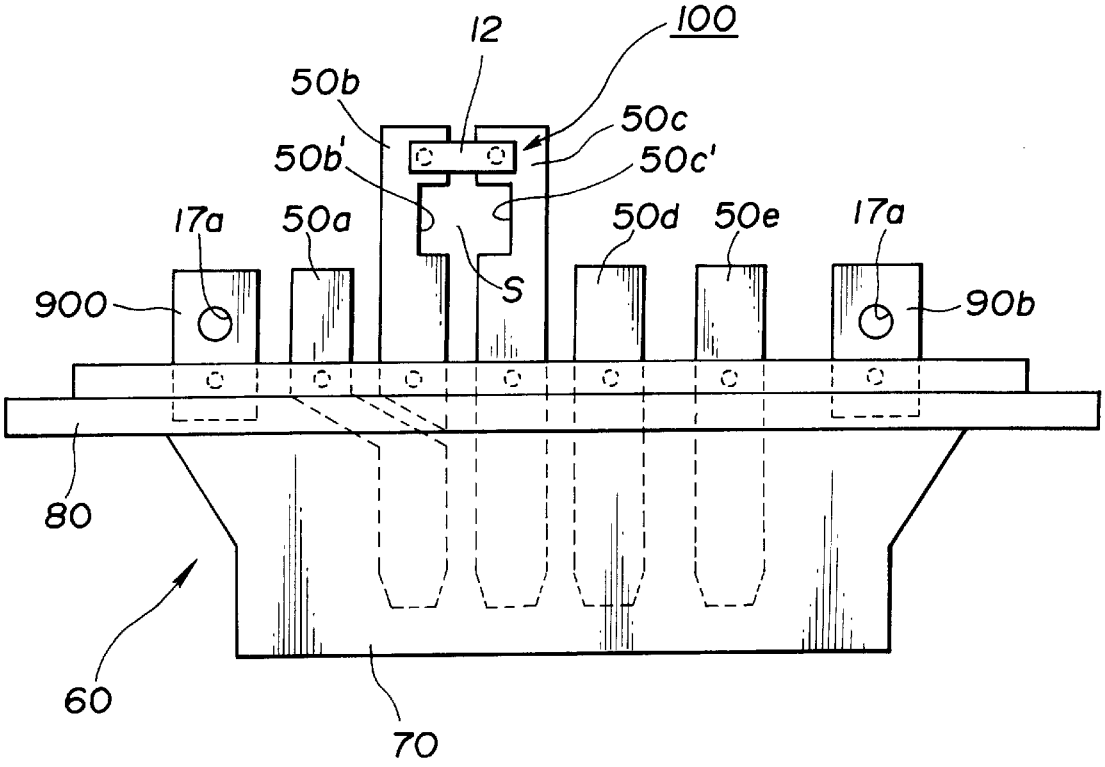
FIG. 3 is a view similar to FIG. 1, but showing a terminal mounted plastic connected used in a first modification of the resistor unit of the invention.
Figure 4:
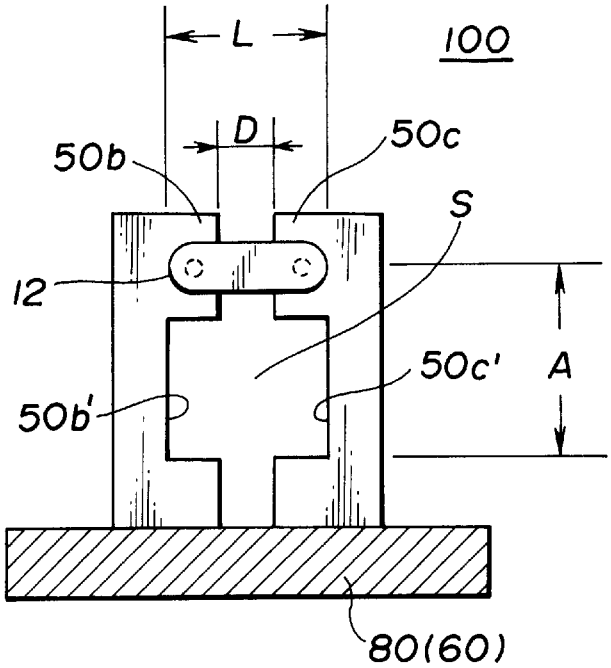
FIG. 4 is a plan view of a fuse holding structure possessed by the first modification.
Figure 5:
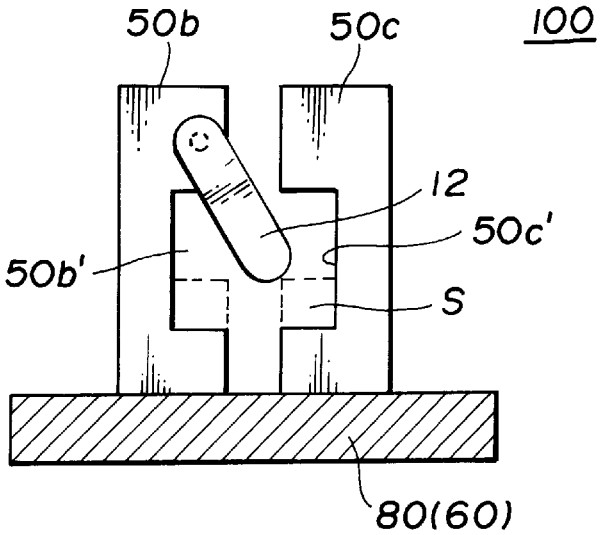
FIG. 5 is a view similar to FIG. 4, but showing a condition wherein a fuse is actually operated.

Referring to FIGS. 3, 4 and 5, there is shown a first modification of the resistor unit of the present invention.

That is, as is well shown in FIG. 3, in this modification, a unique fuse holding structure 100 is provided by the terminals 50*b* and 50*c* of the terminal-mounted plastic holder block 60.

As is seen from FIG. 4, the terminals 50*b* and 50*c* are formed at portions below the fuse 12 with respective rectangular recesses 50*b*' and 50*c*' which face each other. In the illustrated modification, the recesses 50*b*' and 50*c*' are symmetric with respect to an imaginary plane vertically extending between the two terminals 50*b* and 50*c*. With the rectangular recesses 50*b*' and 50*c*', a so-called safety fuse holding space "S" is defined. The space "S" is sufficiently larger than the fuse 12. More specifically, the size and shape of the space "S" are so determined as not to establish an electric connection or short-circuit between the two terminals 50*b* and 50*c* by the fuse 12 once the fuse 12 is operated or burnt out, as is understood from FIG. 5. That is, the distance "A" between the portion of the terminal 50*b* or 50*c* to which the fuse 12 is connected and a lower wall of the safety fuse holding space "S" is greater than the length "L" of the fuse 12. That is, "A>L" is established. In the illustrated modification, the distance between opposed walls of the recesses 50*b*' and 50*c*' is substantially equal to the length "L" of the fuse 12. Of course, the length "L" of the fuse 12 is greater than the distance "D" between opposed portions of the two terminals 50*b* and 50*c* where the fuse 12 is arranged. Due to the provision of the above-mentioned fuse holding structure 100, it never occurs that the fuse 12 accidentally establishes a connection or short-circuit between the two terminals 50*b* and 50*c* when the fuse is operated or burnt out. That is, as is illustrated by a phantom line in FIG. 5, if the size of the fuse holding space "S" is not sufficiently large, the possibility of establishing such undesired connection or short-circuit increases.

Figure 6:
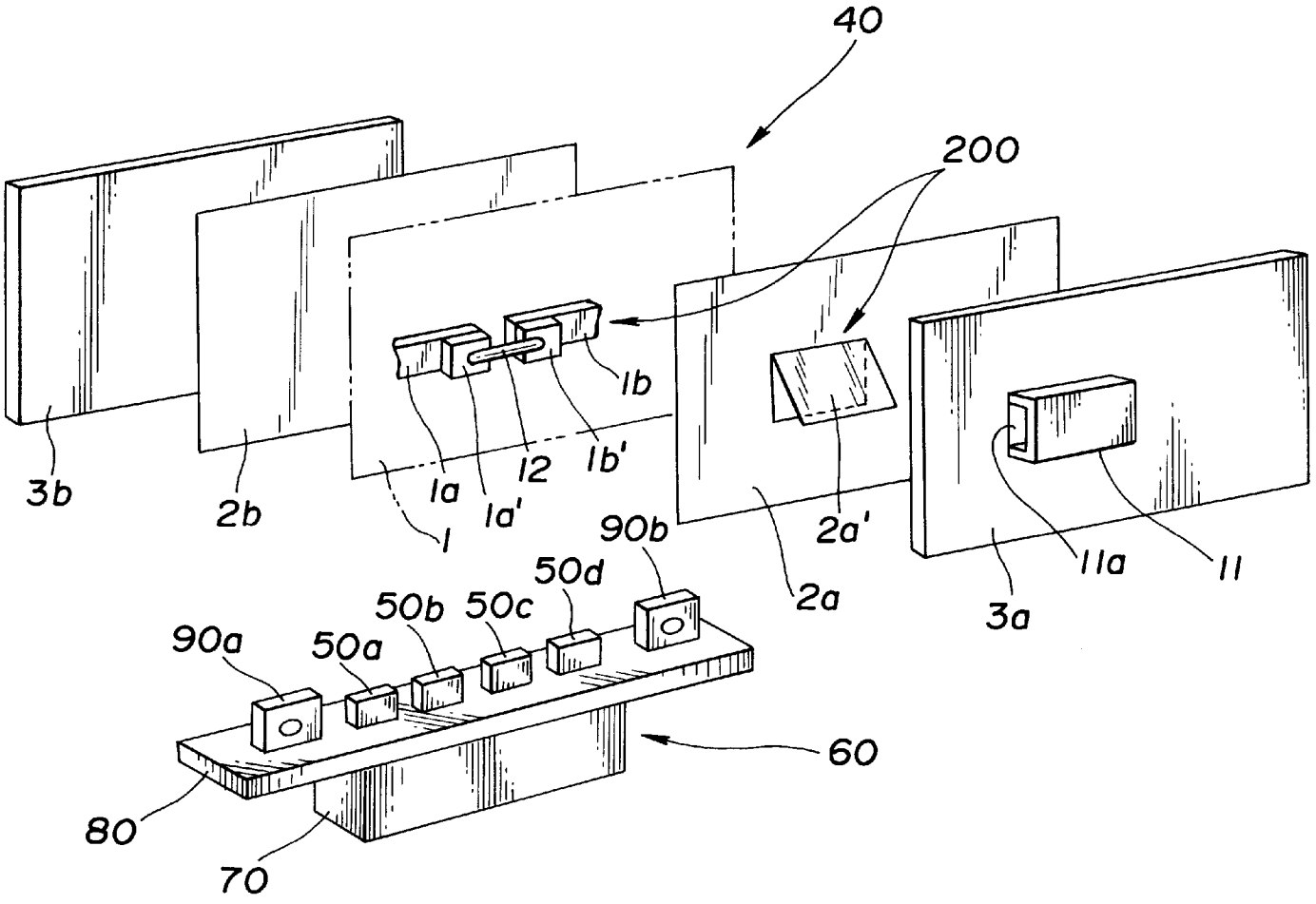
FIG. 6 is an exploded view of a second modification of the resistor unit of the invention, showing a fuse holding structure installed in a resistor proper part.
Figure 7:
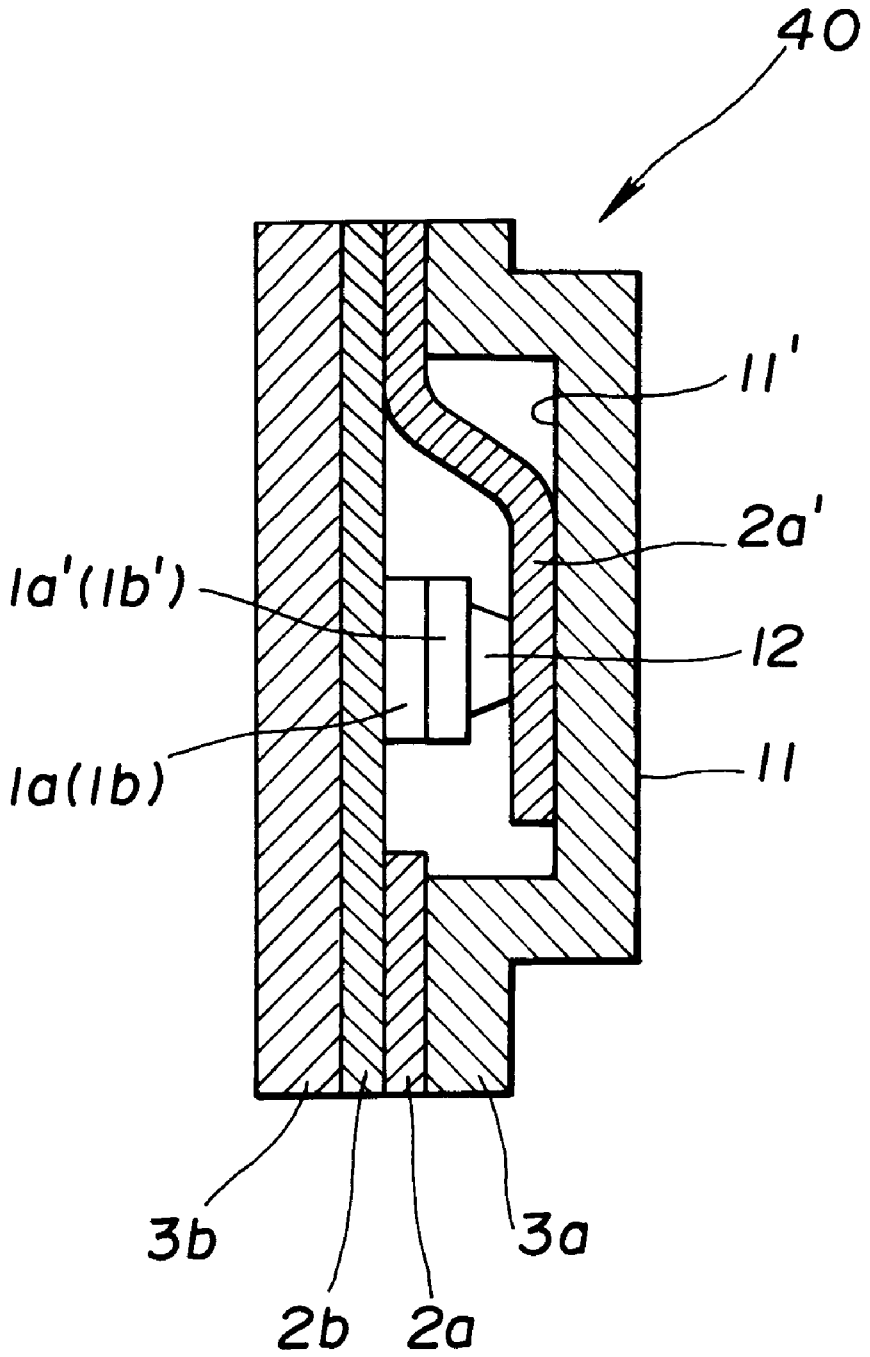
FIG. 7 is an enlarged sectional view of the fuse holding structure of the second modification in an assembled condition.

Referring to FIGS. 6 and 7, there is shown a second modification of the resistor unit of the present invention.

That is, in this modification, a unique fuse holding structure 200 is installed in the resistor proper part 40.

As is seen from FIG. 6, the flat resistor 1 is formed at separated resistor pattern parts 1*a* and 1*b* thereof with respective projections 1*a*' and 1*b*'. A fuse 12 is welded to these two projections 1*a*' and 1*b*' by using a thin solder. Thus, the fuse 12 and the projections 1*a*' and 1*b*' constitute a raised structure (12, 1*a*' and 1*b*') provided on the flat resistor 1.

Thus, in this modification, the terminals 50*b* and 50*c* of the terminal-mounted plastic holder block 60 has no fuse 12 welded thereto, as is understood from FIG. 6.

The insulating plate 2*a* has, at a portion thereof facing the raised structure (12, 1*a*' and 1*b*), a hinged tongue portion 2*a*' pressed out therefrom. In this modification, the insulating plate 2*a* is constructed of a resilient member, such as a glass fiber cloth, flexible mica sheet, silicon sheet, polyimide resin sheet or the like. The heat radiation plate 3*a* is formed at a portion facing the tongue portion 2*a*' with the fuse receiving portion 11. The fuse receiving portion 11 is formed with ventilation openings 11*a* (only one is shown).

As is seen from FIG. 7, when the resistor proper part 40 is properly assembled, the raised structure (12, 1*a*' and 1*b*') of the flat resistor 1 is projected into the fuse receiving portion 11 while pressing the tongue portion 2*a*' of the insulating plate 2*a* against an inner wall 11' of the fuse receiving portion 11. That is, the insulating tongue portion 2*a*' is intimately sandwiched between the fuse 12 and the heat radiation plate 3*a*. Due to the provision of having the insulating tongue portion 2*a*', electric insulation between the fuse 12 and the heat radiation plate 3*a* of metal is assured. Since the raised structure (12, 1*a*' and 1*b*') of the flat resistor 1 is pressed against the inner wall 11' of the fuse receiving portion 11, the same can be tightly and stably held in the fuse receiving portion 11 without play. Due to the nature of the resilient member of which the insulating plate 2*a* is constructed, the opened tongue portion 2*a*' is biased toward a closed position. This biasing force of the tongue portion 2*a*' promotes proper operation of the fuse 12. Furthermore, because of the same reason, when the fuse 12 is operated or burnt out, the tongue portion 2*a*' is forced to take the closed position. This means that the resistor pattern parts 1*a* and 1*b* of the flat resistor 1 are protected from being contaminated by air pollutants.

In addition to the above , the following modifications are possible in the second modification.

If desired, the fuse 12 may be arranged to the terminals 50*b* and 50*c* in a manner as is shown in FIG. 1. In this case, a raised structure like the above-mentioned raised structure (12, 1*a*' and 1*b*') should be provided by the fuse 12 and the terminals 50*b* and 50*c*.

Furthermore, if desired, the other insulating plate 2*a* may be constructed with the above-mentioned resilient member. In this case, the tight and stable installation of the raised structure (12, 1*a*' and 1*b*') in the fuse receiving portion 11 is greatly assured.

In addition to the above, many modifications are available in the present invention without departing from the novel teachings and advantages of the invention. All such modifications are intended to be included within the scope of the present invention as defined in the following Claims.

What is claimed is:

1. A method of producing a resistor unit, comprising:

(a) stamping a metal sheet to produce a shaped single metal sheet, said shaped single metal sheet having a plurality of semi-finish portions which are integrally connected through thin strip portions;

(b) molding a semi-finish product of a molder holder block using said shaped single metal sheet to produce mutually isolated terminals and connecting lugs thereby to finally produce said molded holder block; and (c) mounting a resistor block to said molded holder block using said connecting lugs as a structurally basic connector therebetween.

2. A method as claimed in claim 1, in which said semi-finish portions of said shaped single metal sheet produced by the step (a) are formed with a plurality of openings.

3. A method as claimed in claim 1, further comprising between the step (c) and the step (d):

(e) soldering a fuse to a selected two of said terminals.

4. A method as claimed in claim 1, in which the step (d) is achieved by passing a rivet through both an opening formed in the resistor block and an opening formed in each of said connecting lugs.

5. A method as claimed in claim 1, in which said shaped single metal sheet is shaped so as to have a plurality of horizontal strips and a plurality of vertical strips.

* * * * *

UNITED STATES PATENT AND TRADEMARK OFFICE

CERTIFICATE OF CORRECTION

PATENT NO. : 6,173,487 B1
DATED : January 16, 2001
INVENTOR(S) : Hiroyuki Murata et al.

It is certified that error appears in the above-identified patent and that said Letters Patent is hereby corrected as shown below:

Title page,
Item [30], Foreign Application Priority delete "Mar. 5, 1997 (JP) 8-14406" and insert -- Mar. 5, 1997 (JP) 8-47706 --.

Signed and Sealed this

Eighteenth Day of June, 2002

*Attest:*

*Attesting Officer*

JAMES E. ROGAN
*Director of the United States Patent and Trademark Office*